US006250597B1

(12) United States Patent
Kuo

(10) Patent No.: US 6,250,597 B1
(45) Date of Patent: Jun. 26, 2001

(54) FITTING ADAPTED TO BE FIXED ON AN UPRIGHT WALL OF A BATHROOM

(76) Inventor: Kuo-Yung Kuo, No. 1, Alley 85, Lane 816, Chung-Shan Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/498,829

(22) Filed: Feb. 4, 2000

(51) Int. Cl.[7] ..... A47F 5/08; A47H 1/14

(52) U.S. Cl. ..... 248/231.91; 248/251; 248/339; 248/304; 211/16

(58) Field of Search ..... 248/251, 231.19, 248/304, 339; 211/16

(56) References Cited

U.S. PATENT DOCUMENTS

| | | | | |
|---|---|---|---|---|
| 4,094,490 | * | 6/1978 | Einhorn | 248/489 |
| 4,124,189 | * | 11/1978 | Einhorn | 248/489 |
| 4,907,771 | * | 3/1990 | Wang | 248/222.1 |
| 4,979,713 | * | 12/1990 | Bell | 248/224.3 |
| 5,730,413 | * | 3/1998 | Chen | 248/489 |
| 5,967,476 | * | 10/1999 | Chen | 248/222.14 |
| 6,012,692 | * | 1/2000 | Meck | 248/251 |
| 6,036,156 | * | 3/2000 | Collette et al. | 248/345.1 |

* cited by examiner

*Primary Examiner*—Leslie A. Braun
*Assistant Examiner*—Steve Marsh
(74) *Attorney, Agent, or Firm*—Skjerven Morrill MacPherson LLP

(57) ABSTRACT

A fitting includes an annular shielding member with a rear annular wall adapted to abut against an upright wall of a bathroom to define an abutment plane, and a front annular wall formed with a front major area of a faceplate member. The front major area has a recess extending rearwardly thereof to form an impact bearing portion. A front annular portion surrounds and is connected to the impact bearing portion by an inner annular wall. The impact bearing portion has a rear bearing wall spaced apart from the abutment plane, and a front bearing wall opposite to the rear bearing wall, and defines a fastening hole through the front and rear bearing walls. A holding member includes an anchored end disposed on the rear bearing wall, and having a clamped portion adjacent to the fastening hole so as to abut against an enlarged head portion of an anchoring stud which is inserted into the upright wall. The holding member further includes a holding arm extending from the anchored end and outwardly of the annular shielding member to form a holding end for holding the article, and a fastening member tightening the impact bearing wall against the enlarged head portion of the anchoring stud by passing through the fastening hole. A covering member engages the faceplate member to shield the impact bearing portion from being seen.

6 Claims, 8 Drawing Sheets

FITTING ADAPTED TO BE FIXED ON AN UPRIGHT WALL OF A BATHROOM

BACKGROUND OF THE INVENTION

1. Field of the Invention

This invention relates to a fitting, more particularly to a fitting with a faceplate member and a holding member which is adapted to be clamped between the faceplate member and an upright wall of a bathroom.

2. Description of the Related Art

Referring to FIGS. 1 and 2, a conventional fitting 10 is shown to include a disc-shaped faceplate 11, a positioning plate 12, and a holding member 13. The positioning plate 12 is mounted fixedly on an upright wall (not shown) by fastening members 16. The holding member 13 has an axial screw hole 132 and a holding portion with a holding hole 133 for holding a support member (not shown). A screw 15 passes through a central hole 115 in the faceplate 11 and is inserted threadedly into the screw hole 132 to fasten the holding member 13 on an outer major surface of the faceplate 11 such that the holding member 13 extends transversely from the outer major surface. The faceplate 11 has an engaging seat 111 with an inner wall 112 for engaging an engaging plate portion 121 of the positioning plate 12. The faceplate 11 is fastened to the positioning plate 12 by a fastening screw 14 which extends through a peripheral wall 114 of the faceplate 11 so as to anchor on an anchoring portion 122 of the positioning plate 12.

However, only the screw 15 is used to engage the holding member 13 with the faceplate 11, thereby resulting in unsteady engagement and possible swaying of the holding member 13. Moreover, the conventional fitting 10 has a large number of components, thereby resulting in inconvenience during assembly and manufacture.

SUMMARY OF THE INVENTION

The object of the present invention is to provide a fitting which can ensure firm engagement between a holding member and an upright wall of a bathroom, and which has a fewer number of component so as to facilitate assembly and manufacture.

According to this invention, the fitting includes an annular shielding member which has a rear annular wall adapted to be brought to abut against an upright wall of a bathroom to define an abutment plane, and a front annular wall opposite to the rear annular wall in a direction transverse to the upright wall. A faceplate member has a front major area with an outer periphery which is integrally formed with the front annular wall. The front major area has a recess which extends rearwardly thereof so as to form an impact bearing portion proximate to the abutment plane. The faceplate member further has a front annular portion which surrounds the impact bearing portion and which is distal to the abutment plane, and an inner annular wall which extends in the transverse direction to interconnect the impact bearing portion with the front annular portion. The impact bearing portion has a rear bearing wall which is spaced apart from the abutment plane, and a front bearing wall opposite to the rear bearing wall in the transverse direction, and defines a fastening hole which communicates the front and rear bearing walls. A holding member includes an anchored end which is disposed on the rear bearing wall, and which has a clamped portion adjacent to the fastening hole. When the rear annular wall of the annular shielding member is brought to abut against the upright wall of the bathroom, the clamped portion is adapted to abut against an enlarged head portion of an anchoring stud which is inserted into the upright wall. The holding member further includes a holding arm which extends from the anchored end and outwardly of the annular shielding member to form a holding end for holding the article, and a fastening member which tightens the impact bearing wall against the enlarged head of the anchoring stud by passing through the fastening hole when the clamped portion is brought to abut against the enlarged head portion of the anchoring stud. A covering member is disposed to engage the faceplate member, and includes a peripheral portion to shield the impact bearing portion from being seen.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
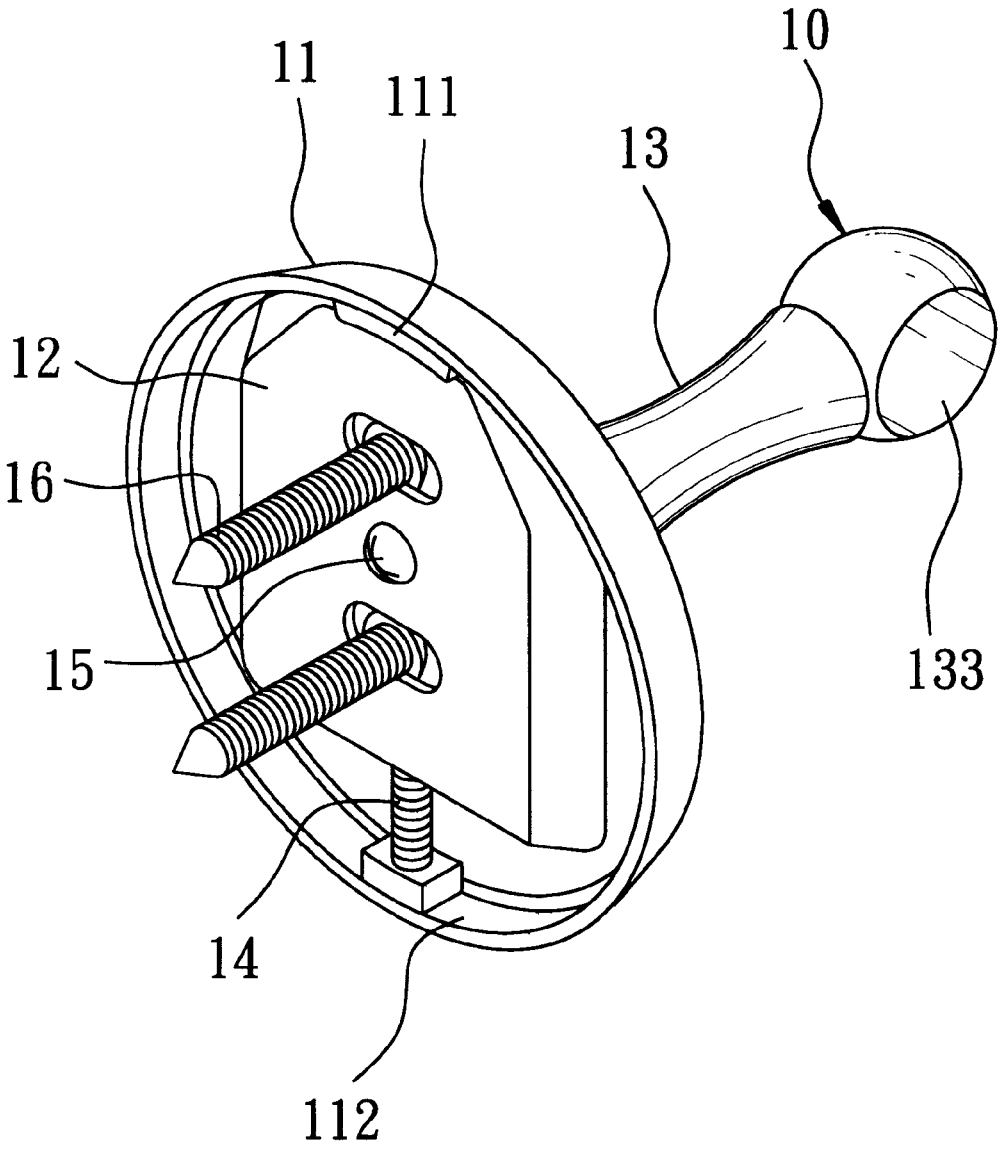
FIG. 1 PRIOR ART
FIG. 1 is a perspective view of a conventional fitting.
Figure 2:
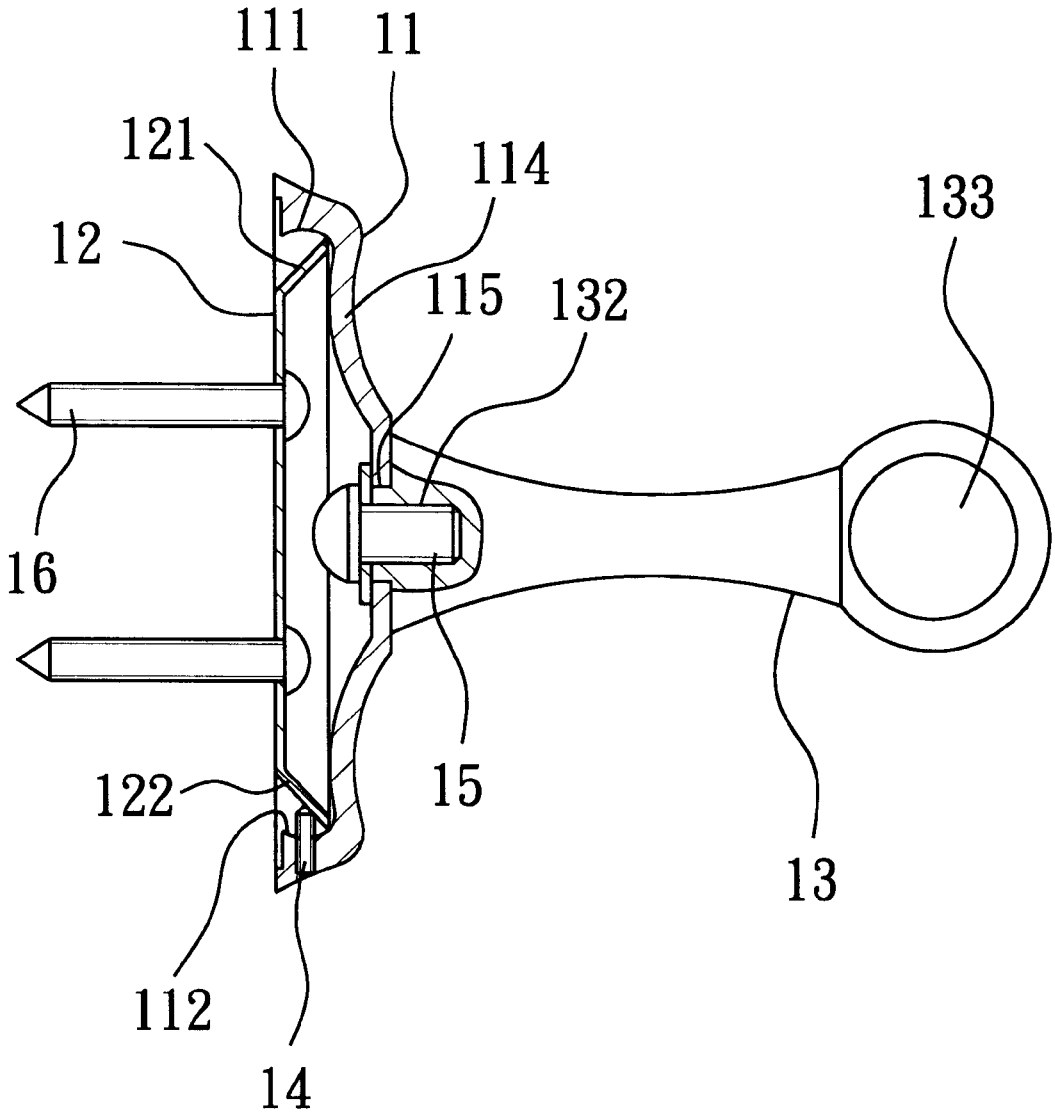
FIG. 2 PRIOR ART
FIG. 2 is a sectional view of the conventional fitting.
Figure 3:
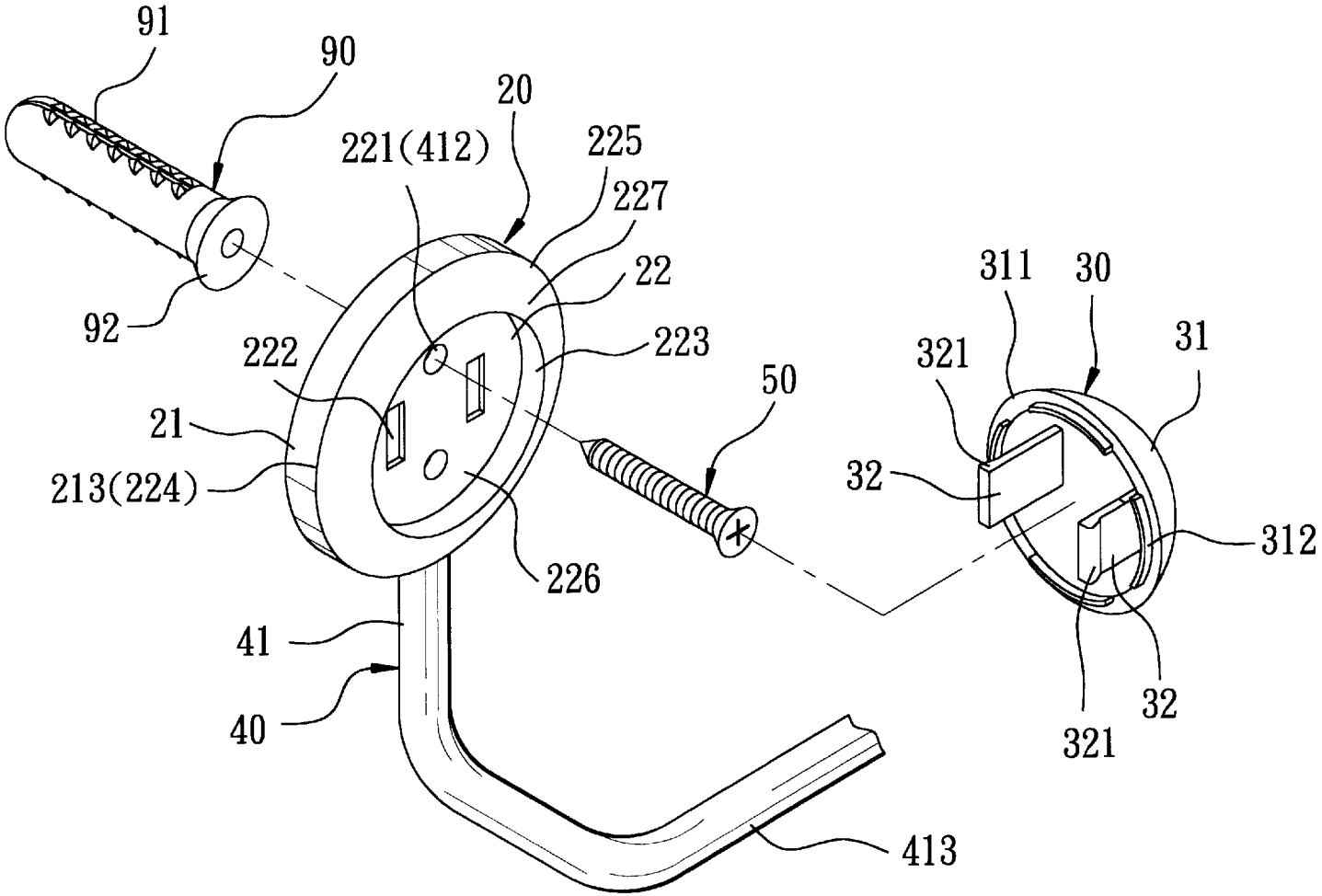
FIG. 3 is an exploded view of a preferred embodiment of a fitting according to this invention.
Figure 4:
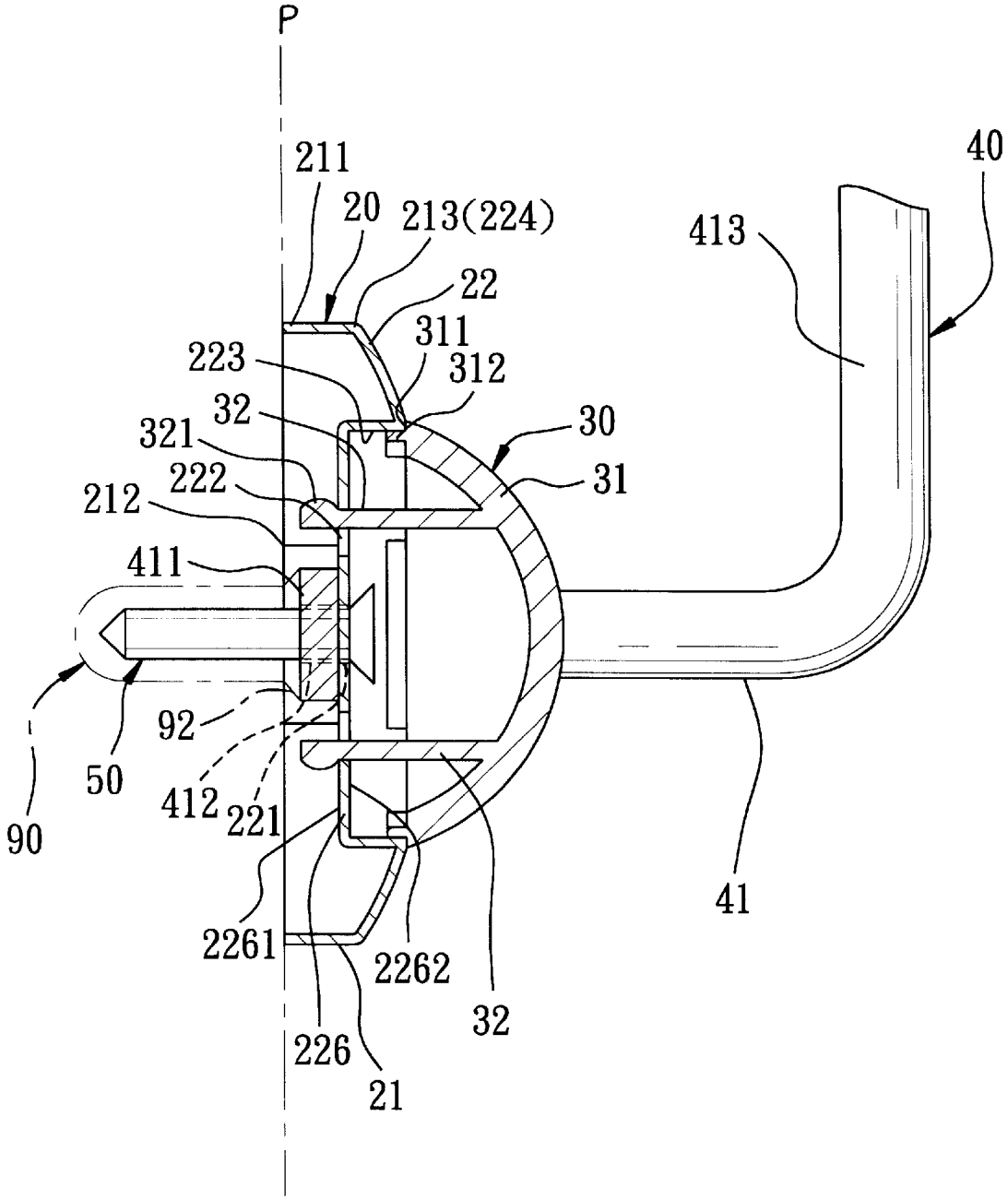
FIG. 4 is a sectional view of the preferred embodiment.

Referring to FIGS. 3 and 4, the preferred embodiment of the fitting according to the present invention is shown to comprise a fitting body 20, a holding member 40, and a covering member 30.

The fitting body 20 includes an annular shielding member 21 and a faceplate member 22. The annular shielding member 21 has a rear annular wall 211 which is adapted to be brought to abut against an upright wall (not shown) of a bathroom to define an abutment plane (P), and a front annular wall 213 opposite to the rear annular wall 211 in a direction transverse to the upright wall. The annular shielding member 21 further has a notch 212 in a bottom thereof. The faceplate member 22 has a front major area 225 with an outer periphery 224 which is integrally formed with the front annular wall 213 of the shielding member 21. The front major area 220 has a recess which extends rearwardly thereof so as to form an impact bearing portion 226 proximate to the abutment plane (P). A front annular portion 227 surrounds the impact bearing portion 226, and is distal to the abutment plane (P). An inner annular wall 223 extends in the transverse direction to interconnect the impact bearing portion 226 with the front annular portion 227. As shown in FIG. 4, the impact bearing portion 226 includes a rear bearing wall 2261 which is spaced apart from the abutment plane (P), and a front bearing wall 2262 which is disposed opposite to the rear bearing wall 2261 in the transverse direction. A pair of fastening holes 221 and a pair of retaining holes 222 are formed in the impact bearing portion 226 to communicate the front and rear bearing walls 2262, 2261.

Figure 5:
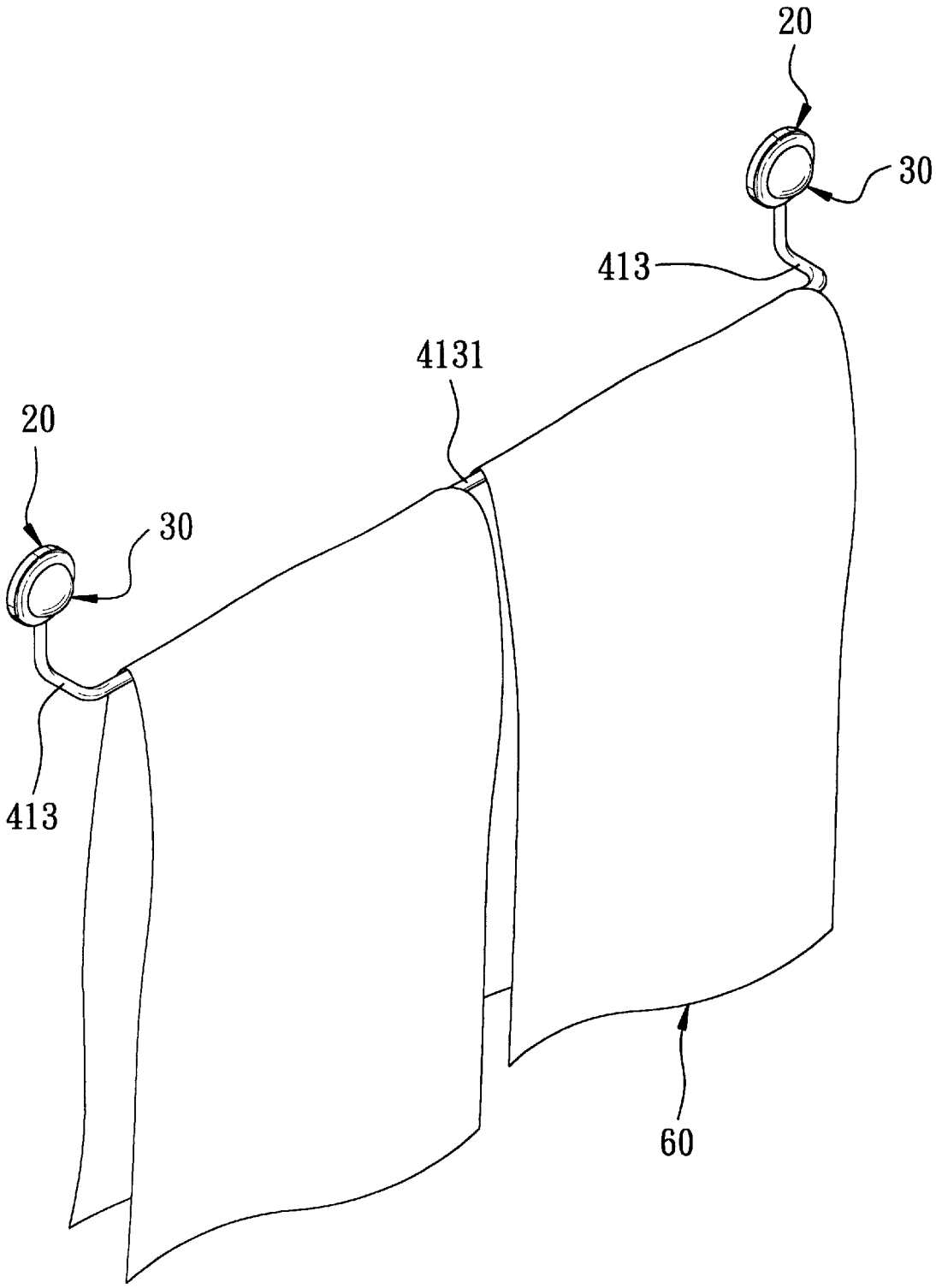
FIGS. 5, 6, 7 and 8 illustrate the use of the preferred embodiment of this invention for holding support members, such as a transverse rod, a plate, a hook, and a loop, respectively.
Figure 6:
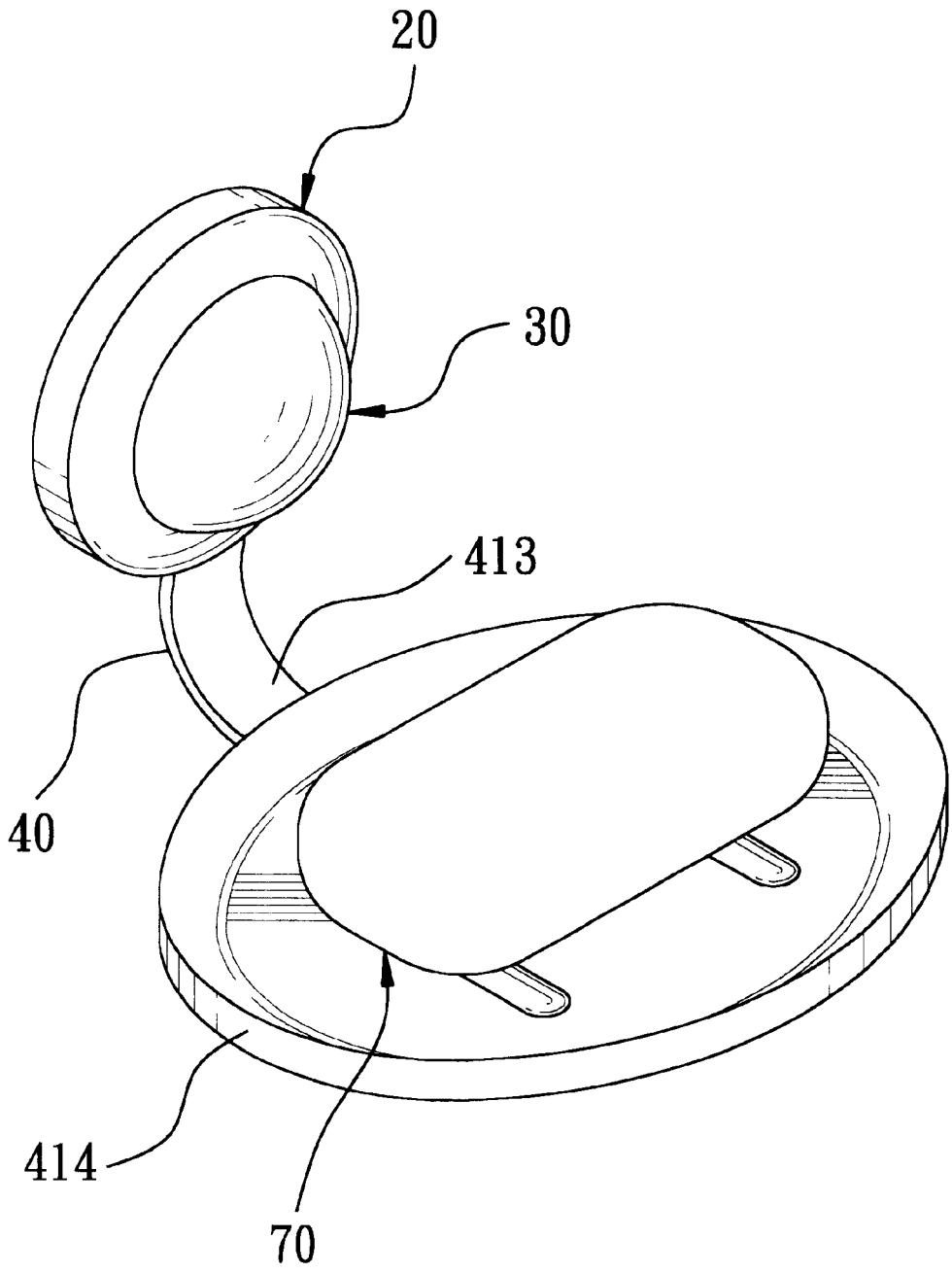
Figure 7:
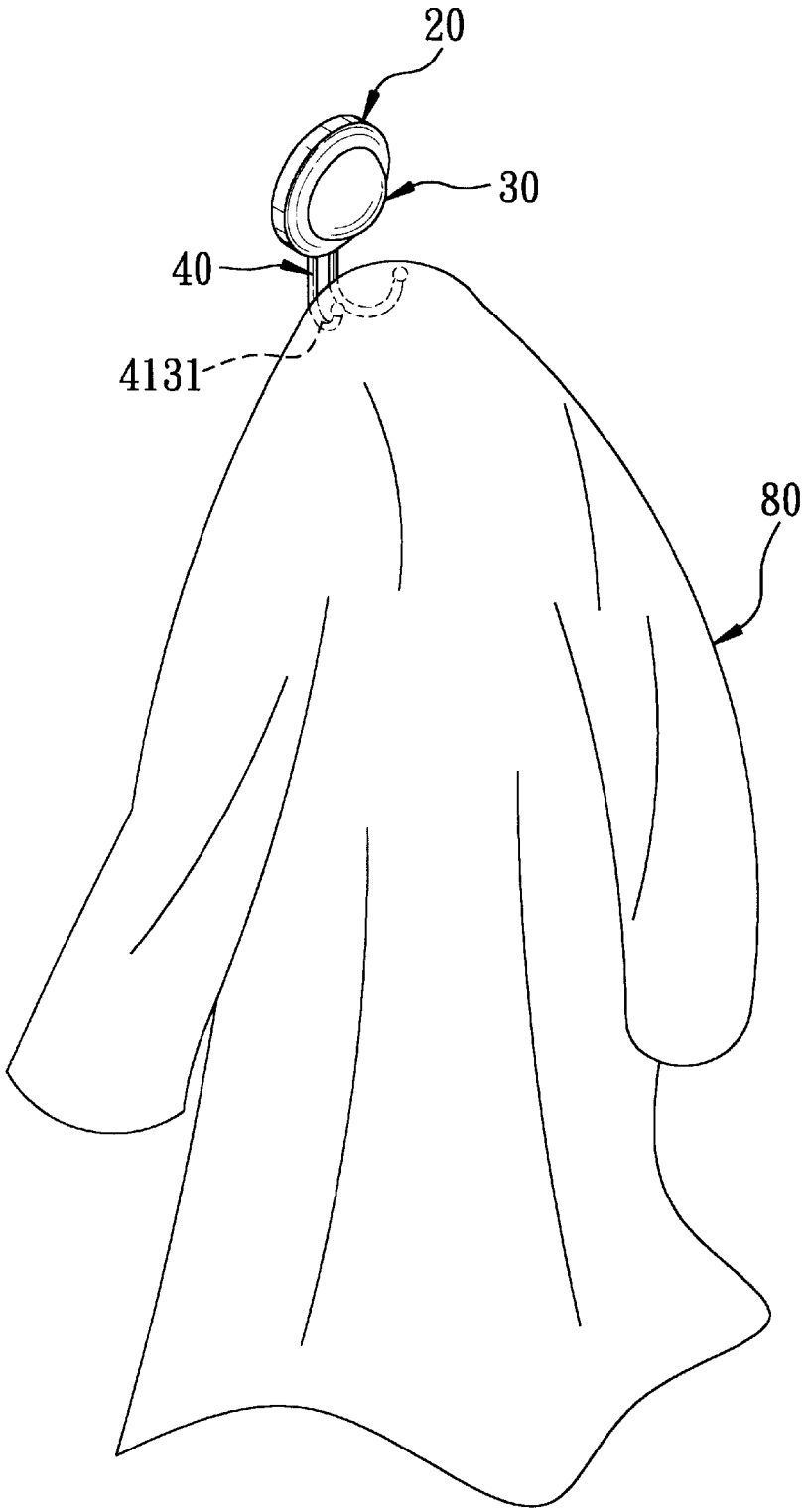
Figure 8:
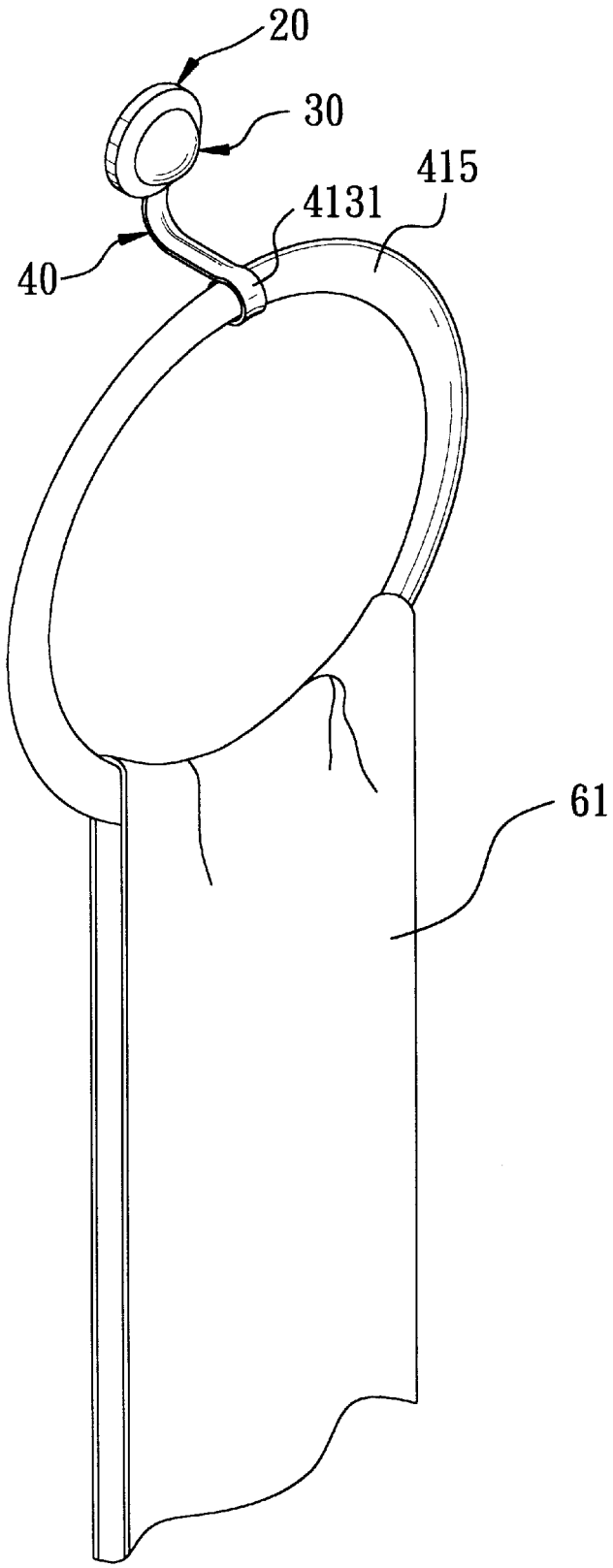

The holding member 40 includes an anchored end 41 and a holding arm 413. The anchored end 41 is disposed on the rear bearing wall 2261, and has a clamped portion 411 which is disposed adjacent to the fastening holes 221 and which has a pair of fastening holes 412 aligned with the fastening holes 221 in the transverse direction. The clamped portion 411 has such a thickness that when the rear annular wall 211 of the shielding member 21 is brought to abut against the upright wall, the clamped portion 411 is adapted to abut against two enlarged head portions 92 of two anchoring stud 90 (only one is shown), each of which has a shank portion 91 inserted in the upright wall of the bathroom. The holding arm 413 extends from the anchored end 41 and outwardly of the annular shielding member 21 via the notch 212 to form a holding end 4131. With reference to FIG. 5, the holding end 4131 can be in the form of a transverse rod, and is connected integrally to the holding end 4131 of another fitting such that a washcloth 60 can be hung over the transverse rod. Moreover, as shown in FIG. 6, the holding end 4131 of the holding arm 413 of the holding member 40 can be in the form of a plate 414 for holding a bar of soap 70. As shown in FIG. 7, the holding end 4131 of the holding arm 413 of the holding member 40 can be in the form of two hooks for hanging a robe 80. As shown in FIG. 8, the holding end 4131 of the holding arm 413 of the holding member 40 can be in the form of a loop so as to receive a support ring 415 for hanging a towel 61.

Two fastening members 50, such as screw bolts, are disposed to pass through the fastening holes 221,412 and be inserted threadedly into the shank portions 91 of the anchoring studs 90 so as to abut the clamp portion 411 of the holding member 40 against the enlarged head portions 92 of the anchoring studs 90, thereby tightening the impact bearing portion 226 against the upright wall. Since the clamped portion 411 of the holding member 40 is clamped securely between the anchoring studs 90 and the impact bearing portion 226, the holding arm 413 of the holding member 40 is secured firmly on the upright wall to guard against detachment when a relative heavy article is held thereon.

Referring again to FIGS. 3 and 4, the covering member 30 includes a peripheral portion 311 which has such a dimension as to shield the impact bearing portion 226 and which has a plurality of arcuate plates 312 that engage the inner annular wall 223. A dome-shaped front covering portion 31 is formed integrally with and extends forwardly from the peripheral portion 311. A pair of retaining legs 32 extend rearwardly from the front covering portion 31 and beyond the peripheral portion 312, and have enlarged portions 321. As such, when the retaining legs 32 are inserted into the retaining holes 222 in the impact bearing portion 226, the enlarged portions 321 thereof can abut against the rear bearing wall 2261 of the impact bearing portion 226 so as to retain the covering member 30 on the faceplate member 22 and hide the impact bearing portion 226.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A fitting adapted to be fixed onto an anchoring stud which is inserted in an upright wall of a bathroom, so as to hold an article spaced from the upright wall, the anchoring stud including a shank portion inserted in the upright wall, and an enlarged head portion extending outwardly of the upright wall, said fitting comprising:

an annular shielding member having a rear annular wall which is adapted to be brought to abut against the upright wall to define an abutment plane, and a front annular wall opposite to said rear annular wall in a direction transverse to the upright wall;

a faceplate member having a front major area with an outer periphery integrally formed with said front annular wall, said front major area having a recess extending rearwardly thereof so as to form an impact bearing portion proximate to the abutment plane, a front annular portion surrounding said impact bearing portion and distal to the abutment plane, and an inner annular wall extending in the transverse direction to interconnect said impact bearing portion with said front annular portion, said impact bearing portion having a rear bearing wall spaced apart from the abutment plane, and a front bearing wall opposite to said rear bearing wall in the transverse direction, and defining a fastening hole which communicates said front and rear bearing walls; a holding member including an anchored end disposed on said rear bearing wall, and having a clamped portion adjacent to said fastening hole and with such a thickness that when said rear annular wall of said annular shielding member is brought to abut against the upright wall, said clamped portion is adapted to abut against the enlarged head portion of the anchoring stud, a holding arm extending from said anchored end and outwardly of said annular shielding member to form a holding end which is adapted to hold the article, and a fastening member adapted to tighten said impact bearing wall against the enlarged head portion by passing through said fastening hole when said clamped portion is brought to abut against the enlarged head portion; and a covering member disposed to engage said faceplate member, and including a peripheral portion of such a dimension as to shield said impact bearing portion from being seen.

2. The fitting as claimed in claim 1, wherein said impact bearing portion further defines at least one retaining hole communicating said front and rear bearing walls, said covering member further having a front covering portion formed integrally with and extending forwardly from said peripheral portion, and at least one retaining leg extending rearwardly from said front covering portion and beyond said peripheral portion so as to press snugly through said retaining hole in the transverse direction for retention therein.

3. The fitting as claimed in claim 2, wherein said retaining leg is formed with an enlarged portion so as to abut against said rear bearing wall of said impact bearing portion when said retaining leg is retained in said retaining hole.

4. The fitting as claimed in claim 1, wherein said holding end of said holding member is formed with a transverse rod adapted for hanging a washcloth.

5. The fitting as claimed in claim 1, wherein said holding end of said holding member is formed with a loop portion adapted for receiving a support ring.

6. The fitting as claimed in claim 1, wherein said holding end of said holding member is formed with a hook portion adapted for hanging clothes.

* * * * *